United States Patent [19]

Supal

[11] Patent Number: 4,842,562

[45] Date of Patent: Jun. 27, 1989

[54] INFLATABLE BUOYANCY BELT

[76] Inventor: Mark L. Supal, 20300 Yale St., St. Clair Shores, Mich. 48081

[21] Appl. No.: 149,582

[22] Filed: Jan. 28, 1988

[51] Int. Cl.[4] ..... B63C 9/16

[52] U.S. Cl. ..... 441/94; 441/108; 441/114; 441/117

[58] Field of Search ..... 441/94, 108, 113, 114, 441/117, 106, 122, 123

[56] References Cited

U.S. PATENT DOCUMENTS

| | | | |
|---|---|---|---|
| 1,538,627 | 5/1925 | Di Lauro | 441/114 |
| 2,802,222 | 8/1957 | Chapman | 441/113 |
| 3,302,224 | 2/1967 | Boucher | 441/94 |
| 3,864,773 | 2/1975 | Geary | 441/94 |
| 4,360,351 | 11/1982 | Travinski | 441/108 X |
| 4,626,221 | 12/1986 | Rocco | 441/108 |

*Primary Examiner*—Sherman D. Basinger

*Attorney, Agent, or Firm*—John R. Benefiel

[57] ABSTRACT

An inflatable buoyancy belt is disclosed comprised of a segment of expandable tubing closed at either end with flattened plugs, carrying fittings enabling adjustable securement of a nonstretchable belt, the tubing segment and connected belt each of a length to extend approximately half way around a wearer's trunk. A gas cartridge holder-inflator fitting is incorporated into one of the end plugs, the gas cartridge releasing a volume of gas only partially inflating the tubing segment, causing a localized bubble to be formed, acting as a buoyancy chamber confined to one side of the wearer's body. The lengthening of the tubing segment at inflation offsets the tightening effect of the bubble to insure a sufficiently loose fit to the wearer so as to allow ready adjustment of the position of the bubble to the wearer's upper trunk.

11 Claims, 2 Drawing Sheets

Fig-5
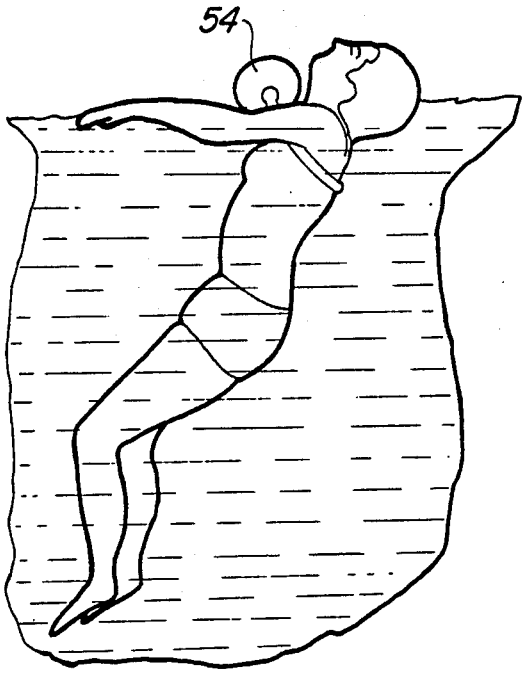
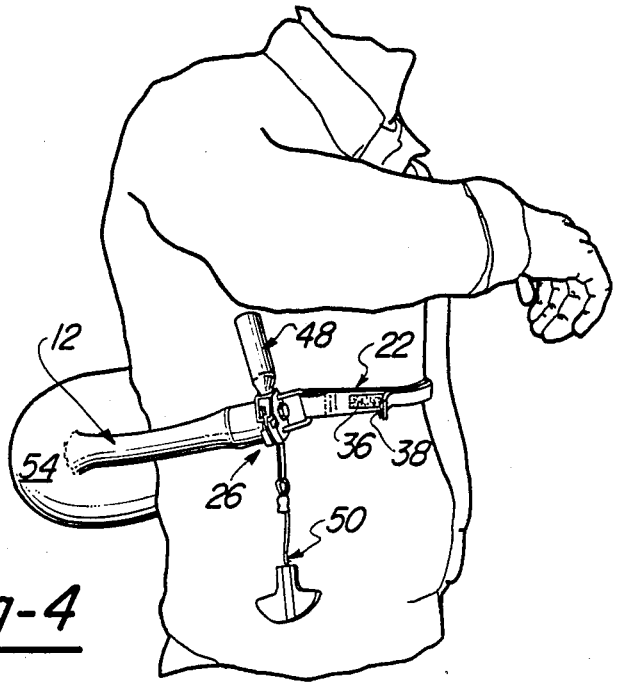
Fig-4
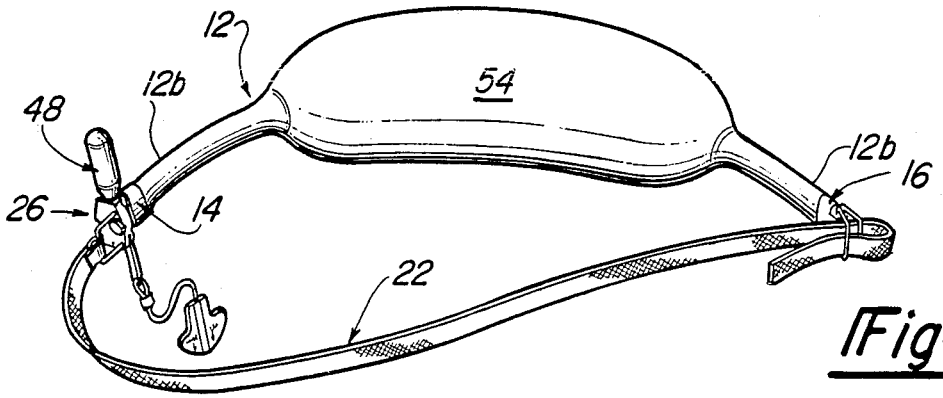
Fig-3

INFLATABLE BUOYANCY BELT

BACKGROUND OF THE INVENTION

This invention concerns flotation devices of the type having a buoyancy chamber inflated by a wearer to keep a wearer immersed in a body of water afloat in emergency situations.

It has long been recognized that inflatable lifesavers have the advantage of being much less bulky and restrictive than lifejackets permanently filled with a solid buoyancy material such as kapok. A number of patents have been issued on inflatable belt devices adapted to be worn about the waist in a normally trim condition, and inflated when necessary in an emergency.

A problem has been encountered with many inflatable belt designs that a constriction pressure is exerted on the wearer at inflation due to the increased diameter of the inflated chamber, particularly where, as is usual, a nonextensible belt member completely encircles the wearer and restricts growth of the length of the inflatable chamber.

An encircling buoyancy chamber fixed at the waist also does not counteract the tendency of a person's upper torso from tipping down into the water when unconscious or exhausted.

Many of these prior art devices are poorly designed, complex arrangements not able to be economically manufactured.

Accordingly, it is an object of the present invention to provide an inflatable belt type device which does not have a tendency to constrict the wearer at inflation and at the same time provides a buoyancy chamber readily positionable above the waist to tend to prevent the wearer's upper torso from tipping down into the water.

It is a further object to provide such a device which is simple and able to be economically manufactured.

SUMMARY OF THE INVENTION

These and other objects of the present invention are achieved by an arrangement comprising an extensible tubing segment of a length able to pass approximately one-half way around the trunk of a wearer, with a nonextensible belt adjustably connected to loops carried by flattened plugs bonded or otherwise secured within either end of the length of tubings.

The belt is of a length to enable an encircling of the wearer's waist partially by the tubing and partially by the belt so that the tubing is positioned across either the front or the rear of the wearer's trunk. The tube is configured such that upon inflation with the volume of gas contained in a gas cartridge, a limited distension of the tubing segment occurs, forming a bubble occupying only a fraction of the tubing length, and creating a localized buoyancy chamber. The tubing segment is lengthened substantially upon inflation so as to counteract the tightening effect otherwise induced by the increased tube diameter, to avoid the tendency for the development of a constricting pressure exerted on the wearer upon inflation. The lengthening effect loosens the fit to the wearer to allow ready repositioning of the bubble to the preferred position, i.e., to the chest of the wearer.

The inflation-cartridge holder fitting forms a part of one of the flattened tubing plugs to simplify the construction of the device. Since standard tubing and belting materials are used for the major components, the device is of a simple design, able to be economically manufactured.

DESCRIPTION OF THE DRAWINGS

FIG. 3 is a perspective view of the belt shown in FIG. 1 in the inflated condition.

FIG. 4 is a perspective view of the belt shown in FIG. 3 secured around the trunk of a wearer in the inflated condition.

FIG. 5 is a perspective view of a person wearing the inflated belt while immersed in a body of water, the bubble buoyancy chamber positioned to the person's chest.

DETAILED DESCRIPTION

Figure 1:
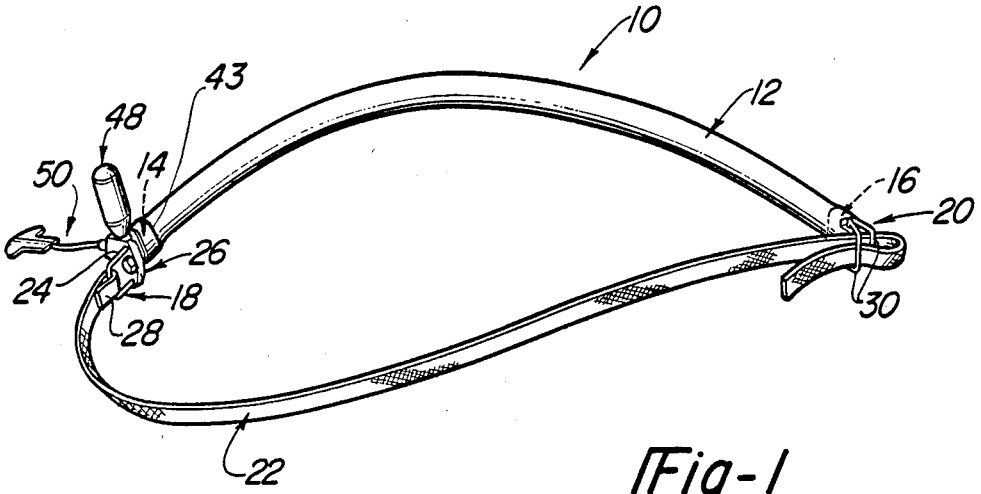
FIG. 1 is a perspective view of an inflatable buoyancy belt according to the present invention shown in the uninflated condition.
Figure 2:
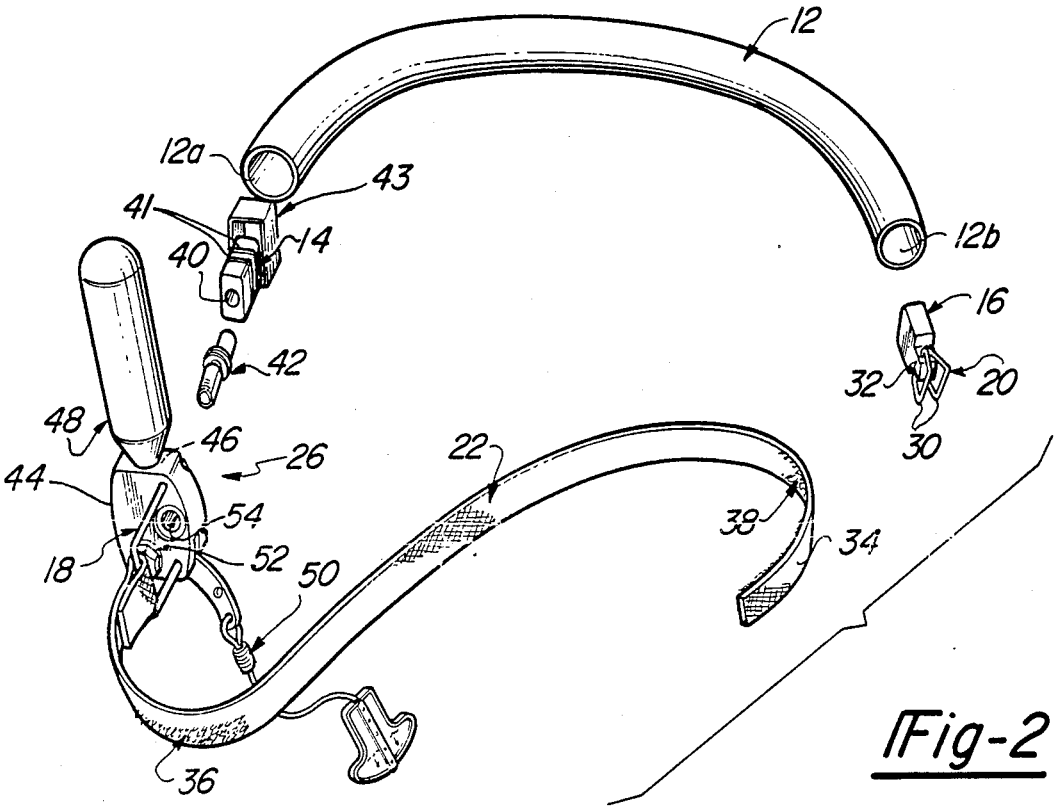
FIG. 2 is an exploded enlarged perspective view of the belt shown in FIG. 1.

In the following detailed description, certain specific terminology will be employed for the sake of clarity, and a particular embodiment described in accordance with the requirements of 35 USC §112, but it is to be understood that this is not intended to be limiting inasmuch as the invention is capable of taking many forms and variations within the scope of the appended claims.

Referring to the Drawings, the inflatable buoyancy belt 10 is depicted in the uninflated condition. The belt 10 includes a segment of tubing 12 of extensible material such as rubber, the ends thereof sealed by respective flattened plugs 14 and 16 bonded or otherwise secured within the interior of the ends 12*a*, 12*b* of the tubing segment 12. The flattened shape of the plugs 14, 16 allows a trimmer fit in conformity with the belt nature of the device. Tightly fitted rings 43 (shown only around plug 14) may be utilized surrounding the tubing 12 and plugs to improve sealing and increase the resistance to pull out plugs 14, 16 from the tubing 12. Ribs 41, shown only on plug 14 may also be formed to improve sealing and pull out resistance.

Each of the plugs 14, 16 supports belt fittings 18, 20 adapted to adjustably connect a belt 22 of a relatively nonextensible material, as of a thick woven fabric to the ends 12*a*, 12*b* of the tubing segment 12. This is to allow an encircling of the waist of a human wearer, as will be described hereinafter.

Belt fitting 18 comprises a single metal loop 24 rigidly affixed to project from an inflation fitting 26 secured to plug 14, with one end 28 of the belt 22 looped and sewn therearound to be permanently connected thereto.

Belt fitting 20 comprises a pair of metal loops 30 loosely received in clevis 32 of plug 16 to allow a frictional lock to the other end 34 of belt 22 when looped therethrough in the manner well known.

Velcro (TM) strips 36, 38 sewn to belt 22 may be used to secure any adjusted position of the belt 22.

Plug 14 is formed with a through opening 40 allowing communication with the interior of the tubing segment 12 therethrough, and receives a porting member 42 bonded therein included in the inflation fitting 26.

Inflation fitting 26 is of a well known commercially available type, as described in detail in U.S. Pat. No. 3,764,791, and includes a housing 44 to which porting member 42 is sealingly secured. Housing 44 is formed with a threaded seat 46 adapted to receive the threaded end of a compressed gas cartridge 48, of the standard commercially available $CO_2$ inflator type. The $CO_2$ cartridge 48 extends transversely to the tubing segment 12 as is adapted to have the sealed end thereof pierced by pulling a lanyard so as to allow the compressed gas to flow into the interior of the tubing segment 12 via internal passages in the housing 44 and the interior of porting member 42.

A venting plug 52 allows deflation through bore 54.

The characteristics of the tubing segment 12 are selected so that upon inflation with the volume and pressure of gas contained in a standard $CO_2$ cartridge (i.e. 16 gm filled $CO_2$ cartridge) only partial inflation of the tubing segment 12 occurs, as illustrated in FIGS. 3–5. That is, a 16 gm filled $CO_2$ cartridge provides such partial inflation to cause formation of a bubble 54 intermediate the length of tubing segment 12, substantially centered between the ends 12*a* and 12*b*.

A one inch diameter latex rubber tube approximately one and a half feet long, having a wall thickness of one sixteenth of an inch has been successfully employed to produce this effect utilizing a 16 gm filled $CO_2$ cartridge.

The length of the tubing segment 12 is such as to only partially encircle the wearer's body as seen in FIG. 4, such that the bubble 54 is confined to one side of the wearer and cannot constrict against the wearer's waist or trunk upon inflation.

Furthermore, it has been found that the lengthening of the tubing segment 12 occurring upon inflation offsets the tightening effect of the formation of the buoyancy chamber defined by the bubble 54 so that easy adjustment of the position of the bubble 54 to the chest of the wearer may be made.

Thus, if the belt 10 is inflated to the rear as in FIG. 4, the wearer may move the bubble 54 to the preferred under-the-chin chest position as shown in FIG. 5. The belt 10 may be more suitably worn in the deflated condition with tubing segment 12 across the front of the chest or waist allowing inflation of bubble 54 directly at the front of the user and adjustment to the level shown in FIG. 5.

Thus it may be appreciated that the above recited objects have been accomplished by a simple design able to be manufactured from low cost components, i.e., standard rubber tubing, belting material and fittings, inflation fitting, etc., while alleviating disadvantages associated with prior art inflatable belt safety devices.

I claim:

1. An inflatable buoyancy belt comprising:

a segment of extensible tubing of a length to extend only approximately one half of the way around the trunk of a human wearer;

a plug secured within each end of said tubing segment so as to be retained therein and seal the interior of said tubing segment, each of said plugs having protruding belt fittings carried thereon, and one of said plugs formed with an inflation opening extending therethrough into the interior of said tubing segment;

a length of belting adapted to be adjustably secured to said belt fittings so that the combination of said belt and said segment of tubing is able to completely encircle the trunk of a wearer;

inflation means comprising an inflation fitting carried by said one of said plugs including means for receiving a cartridge of compressed gas and releasing said compressed gas into said tubing interior;

a cartridge of gas received in said inflation fitting containing a quantity of gas of a volume and pressure such as to at least partially inflate said tubing segment when released thereinto, to form an inflated buoyancy chamber;

said tubing segment being unrestrained lengthwise and substantially lengthened when inflated by release of gas thereinto, to loosen the fit to a wearer to enable ready repositioning of said tubing segment on a wearer.

2. The inflatable buoyancy belt according to claim 1 wherein said volume and pressure of said gas and said tubing segment characteristics creating only a partial inflation thereof in a localized region to form a bubble in said tubing segment substantially centered between the ends of said tubing segment which can be repositioned upon said loosening of the fit to said wearer.

3. The inflatable belt according to claim 2 wherein said extensible tubing segment comprises a latex rubber tube approximately one inch in diameter and one and a half feet in length.

4. The inflatable belt according to claim 2 wherein said gas cartridge contains 16 gm fill of $CO_2$ gas.

5. The inflatable buoyancy belt according to claim 1 wherein said belt is of a substantially nonextensible material.

6. The inflatable belt according to claim 1 wherein the other of said plugs is formed with a clevis portion loosely receiving a pair of loops comprising said belt fittings.

7. The inflatable belt according to claim 1 wherein said inflation fitting includes a housing having a threaded bore configured to receive said gas cartridge extending transversely to said tubing segment.

8. The inflatable belt according to claim 1 wherein said inflation fitting includes a rigidly affixed metal loop through which a length of belting may be looped and sewn therearound to be permanently connected thereto.

9. The inflatable belt according to claim 1 wherein each plug is a flattened shape in conformity with said belt to provide an overall trim fit.

10. The inflatable buoyancy belt according to claim 9 further including a ring surrounding at least one of said plugs and the tubing segment overlying said plug.

11. A method of forming a buoyancy chamber in a segment of extensible tubing connected at the ends thereof with a nonextensible belt to be able to be fit around the trunk of a human wearer, comprising the step of inflating said tubing segment with a volume of gas at a pressure and volume to produce a localized distension of said tubing segment at an intermediate region along the length thereof to form a bubble therein acting as said buoyancy chamber, while extending the length of said tubing segment by said inflation sufficient to loosen the fit to a wearer to enable ready repositioning of said bubble on said wearer.

* * * * *